US008633145B1

(12) United States Patent
Dowdle

(10) Patent No.: US 8,633,145 B1
(45) Date of Patent: Jan. 21, 2014

(54) METHODS FOR REMOVAL OF COSMETIC RESIDUE FROM SURFACES

(71) Applicant: Lynn Dowdle, Dallas, TX (US)

(72) Inventor: Lynn Dowdle, Dallas, TX (US)

( * ) Notice: Subject to any disclaimer, the term of this patent is extended or adjusted under 35 U.S.C. 154(b) by 0 days.

(21) Appl. No.: 13/724,637

(22) Filed: Dec. 21, 2012

(51) Int. Cl.
*C11D 17/00* (2006.01)

(52) U.S. Cl.
USPC ..... 510/218; 510/220; 510/424; 510/426; 510/439

(58) Field of Classification Search
None
See application file for complete search history.

(56) References Cited

U.S. PATENT DOCUMENTS 4,600,522 A 7/1986 Grzeskowiak, Jr. et al.
5,346,640 A 9/1994 Leys
6,436,893 B1 8/2002 Lentsch et al.
6,812,202 B2 11/2004 Man et al.
2005/0227884 A1 10/2005 Maser et al.
2008/0132438 A1* 6/2008 Hoffman et al. ..... 510/380

FOREIGN PATENT DOCUMENTS

WO 9804660 A1 2/1998

* cited by examiner

*Primary Examiner* — Necholus Ogden, Jr.
(74) *Attorney, Agent, or Firm* — Shaukat A. Karjeker; David W. Carstens; Carstens & Cahoon, LLP

(57) ABSTRACT

A non-toxic formulation for removing cosmetic residue from glass, porcelain, polymeric and textile surfaces includes an anionic surfactant; ethanol; glycerin; water; and optionally an edible fragrance. Optionally, the exemplary formulation includes from about 0.1 to about 10 wt. % iso-propyl alcohol, or about 5 wt. %. Optionally, the surfactant is selected from the group consisting of sodium alpha-olefin sulfonates, and further optionally, the surfactant comprises sodium 14, 16 alpha-olefin sulfonate. In another exemplary embodiment, convenient wipes are provided that are impregnated with the formulation.

24 Claims, 6 Drawing Sheets

METHODS FOR REMOVAL OF COSMETIC RESIDUE FROM SURFACES

BACKGROUND

1. Technical Field

The technology relates to the field of cleaning formulations, applicators for such formulations, and methods of using such formulations and applicators; more particularly, the technology relates to removal of stubborn residues of cosmetic formulations from surfaces.

2. Description of the Related Art

Cosmetics commonly referred to in the US as "make-up," have been in use at least since the time of the Pharaohs. In the late $20^{th}$ century, the use of make-up increased significantly with the rise of major manufacturers and marketers such as Revlon, L'Oreal, Estee Lauder, Elizabeth Arden, and many others. The term "cosmetics" covers a wide range of products that are perceived to enhance beauty. Often, cosmetics include compositions that may have, or that are asserted as having, health enhancement properties, for example, "sun screen" agents in facial creams, to minimize potentially harmful levels of ultra-violet solar radiation, and lotions that include anti-oxidants.

With regard to cosmetics applied to the lips, these are available in a range of products, colors and textures. Lipstick is well known, and is most commonly supplied in a cylindrical container that allows presentation of the "stick" as a colored, waxy solid that can be easily applied to the lips. Lipstick generally includes pigments that provide the desired color, a carrier of a mixture of oils and waxes, and emollients (moisturizers and skin conditioners). Lip-gloss is a sheer composition applied to the lips, most commonly as a liquid using an applicator referred to as a "doe foot applicator," to impart a glossy sheen. Lip balm may include a composition to prevent drying out of the lips, and may include a moisturizing conditioner. Lip balm is often clear (not colored) but may be colored. Lip plumper, which may be solid, gel/cream or liquid, is formulated with compositions, such as niacin or retinol, or a harmless skin irritant (e.g., menthol, camphor, cayenne, cinnamon), that causes the lips to swell and become fuller ("plumper"). Lip plumpers may range from translucent to any color desired. Lip plumper may be formulated to be used by itself as a lip-gloss, or may be formulated for receiving an application of lipstick over the lip plumper.

While there has been a growing trend toward the use of "natural" ingredients and organic ingredients in cosmetics, there has also been a demand for cosmetics that are suited to an active lifestyle, and for a bust work day. As a result, there has been a growing market for a long wearing lipstick that does not require frequent application and does not come off the wearer's lips readily, so that fresh application, or "touch up," might be required fewer times daily, sometimes only once or twice in an eight hour work day. In response to this need, the cosmetics manufacturers developed new lipstick formulations. The "traditional" lipstick, which generally has to be "freshened" several times a day, has a "soft waxy solid" carrier structure that results from the use of a wax, or a mixture of waxes, typically including carnauba wax (a high melting point wax for structural support), beeswax, ozokerite, and candelilla wax. The carrier formulation further includes oils and fats that are blended with the waxes to provide the texture and sheen of the lipstick. These oils and waxes include, for example, olive oil, mineral oil, cocoa butter, lanolin, and petrolatum. Some may contain pig fat and castor oil in addition, to improve the shiny appearance when applied.

The recent introduction of "long wearing" lipstick was made possible by changes in lipstick formulations to include compositions that reduce the tendency of traditional lipstick to gradually wear off the lips during normal daily activities of talking, drinking, eating, etc. These formulations adhere more stubbornly to the lips, and may also be expected to adhere more stubbornly to other surfaces, for example the surface of a drinking glass or cup. This lipstick residue often resists cleaning in ordinarily used cleaning methods, for example automatic dish washing machines used in restaurants, resulting in the embarrassing presentation of a "cleaned" glass or cup with lipstick residue to a customer.

US Patent Publication 2005/0227884 discusses a method of removing lipstick residue, particularly such residue from long wearing lipstick, from a glass or cup (collectively, "drink ware") by pretreating the used drink ware with a chemical formulation prior to the usual cleaning in a dish washing machine. The pretreatment formulation includes at least 0.1 to 100 wt. % of a solvent specified as a ketone; an ester, such as the soy esters; a paraffin hydrocarbon, such as Norpar 13, available from Exxon Mobil; and a glycol ether, glycol, or a terpene. In addition, the formulation includes an organic surfactant (from a specified list), a hydrotrope to assist in dissolving all the components of the formulation, a dye a viscosity modifier, and a source of alkalinity, such as sodium or potassium hydroxide, and a builder, such as sodium tripolyphosphate. The pretreating formulation is a liquid solution and may be applied either only to the rim of the drink ware, where the residue is typically found, or to the entire drink ware surface. The pretreatment solution can be applied by spraying, misting, foaming, dipping, wiping, fogging, or rolling. Thereafter, the drink ware is washed in a washing machine. There is no indication that the pretreatment solution is non-toxic, or that it can be ingested in any amounts, without harm. Since the drink ware is subsequently cleaned in a washing machine, toxicity may not be of concern.

U.S. Pat. No. 5,346,640 relates to a cleaning composition, asserted to clean graffiti from walls, and also lipstick from surfaces. The patent describes five different cleaning liquid compositions, each directed to a specific cleaning job. Each of the cleaning liquids includes the "stem ingredients" which are N-methylpyrrolidone, propylene carbonate, isocetyl)-alcohol, dipropylene glycol methyl (or mono-methyl)ether acetate.

PCT Publication WO 1998/004660 is directed to a glass washing composition said to be effective in cleaning lipstick from glass. The composition includes a nonionic surfactant, a suitable solvent, such as water, and optionally a co-solvent, such as a short chain alcohol. The nonionic surfactant may be present in the range 2.5 to 50 wt. %, and is preferably a low foaming surfactant selected from the alkoxylate surfactants. The co-solvent is preferably selected from isopropyl alcohol, white mineral spirits, glycols and sodium cumene sulfonate.

U.S. Pat. No. 4,600,522 relates to a biodegradable cleaning composition asserted to be effective in cleaning lipstick residues. This cleaning composition includes a furan-based alcohol mixed with a nonionic surfactant, an aromatizing composition, and an emulsifier.

U.S. Pat. Nos. 6,812,202 and 6,436,893 relate to an alkaline detergent composition asserted to be effective in cleaning lipstick residues. The detergent composition includes a blend of nonionic surfactants, an alkyl polyglycoside surfactant, and a silicon surfactant having a hydrophobic group and a pendant hydrophilic group.

SUMMARY

Exemplary embodiments of the technology provide formulations, applicators or carriers for the formulations, and methods of using the formulations to remove cosmetic residue from surfaces, especially for removing more stubborn residues, such as for example, long wearing lipstick residue from drink ware, clothing, and other surfaces. In the case of clear or translucent surfaces, the formulations provide a cleaned surface that is streak-free and shiny-clean to the eye.

In an exemplary embodiment, a non-toxic, sanitizing formulation for removing cosmetic residue from glass and porcelain and polymeric surfaces includes an anionic surfactant; ethanol; glycerin; and optionally an edible fragrance. Optionally, the exemplary formulation may include from about 0.1 to about 10 wt. % iso-propyl alcohol, or about 5 wt. %. Further optionally, the surfactant may be present at from about 0.1 to about 3 wt. %., or about 1 wt. %. Optionally, the formulation may have from about 35 to about 70 wt. %., or about 55 wt. % of ethanol. Optionally, the formulation may have from about 0.1 to about 5 wt. %, or about 3 wt. % of glycerin. Optionally, the surfactant may be selected from the group consisting of sodium alpha-olefin sulfonates, and further optionally, the surfactant may include sodium 14, 16 alpha-olefin sulfonate.

Another exemplary embodiment provides a wipe impregnated with a non-toxic, sanitizing aqueous formulation for removing long wearing lipstick residue from glass, porcelain and plastic surfaces. The wipe acts as a carrier for a formulation and has about 35 to about 70 wt. % ethanol; about 0.1 to about 5 wt. % glycerin; an anionic surfactant; isopropyl alcohol; optionally an edible fragrance; and water. The wipe may optionally be made of woven fibers, such as nylon, cotton, and the like. Moreover, the wipe may be textured to provide a mild soft scrubbing to a surface and/or may be textured to enhance polishing of surfaces.

In some exemplary embodiments the formulation is an aqueous liquid, and in other exemplary embodiments, it is an alcohol-based solution, free of water, which is added in the cleaning stage. In some embodiments it is supplied in a sealed sachet that dissolves in water to release the sanitizing and cosmetic residue-cleaning formulation contained therein. In other exemplary embodiments, it is provided as a concentrated bulk liquid for dispersal or mixing into water that will be used to clean cosmetic residue-marked surfaces and to sanitize these.

The foregoing summary is not exhaustive; more details and exemplary embodiments about the cosmetic residue removal formulation technology that is the subject of the appended claims are provided here below.

BRIEF DESCRIPTION OF THE DRAWINGS

The following drawings are not to scale and depict exemplary, non-limiting embodiments that are intended to facilitate an understanding of the inventions, which are set forth in the appended claims. The technology may be best understood by reference to the following Detailed Description, when read in conjunction with the accompanying illustrative, not-to-scale drawing, wherein:

DETAILED DESCRIPTION

The term "exemplary" as used herein, means "an example of," and the examples provided herein are non-limiting of the invention, which is solely expressed in the patent claims. In the specification and claims, the term "cosmetic residue" means residue that results from cosmetics having contacted a surface and having adhered to that surface after such contact. Sometimes at least a portion of that residue remains tightly bound to the surface, even after a standard cleaning procedure, appropriate to that surface, has been applied. While much of the following discussion focuses on lipstick, and long wearing lipstick, other cosmetics may have similar effects with regard to residues. Further, while much of the discussion may focus on drink ware, for ease of explanation, the formulations are also useful in cleaning other surfaces, such as clothing of natural or synthetic materials, or both. The term non-toxic, as used in the specification and claims means compositions, and formulations of these compositions, that are either not toxic when ingested or that are present in such minute and barely detectible residual amounts, if any, on cleaned surfaces as to pose virtually no risk to human health, if ingested in food or drink in contact with that surface. The term "sanitizing" as used in the specification and claims relates to the capability of embodiments of the formulation to clean surfaces having a cosmetic residue of micro-organisms associated with that residue, to thereby significantly reduce the population of the micro-organism and any associated risk.

The introduction of long wearing lipstick has exacerbated an issue that has long presented in the field of cleaning glass and porcelain surfaces, in particular, of lipstick residue resulting from contact with lips of the wearer. Even after washing drink ware, for example, in a dish washing machine, at temperatures selected to ensure sterilization of pathogens, the residue often remains. Although the drink ware is not contaminated with pathogens, the residue is nonetheless unsightly and evokes feelings of distaste, resulting in a diminished impression of the standards of hygiene of an establishment that serves beverages in such drink ware. The removal of such residues is, therefore, of some significance to business establishments.

In addition, sometimes when make-up is being applied, the lipstick might slip from the grasp and in falling cause a mark on clothing: a blouse, scarf, skirt, pants, or the like. These marks are not readily removable with standard cleaning techniques, especially marks from long wearing lipstick. In fact, some techniques may result in "setting" of the mark and make it virtually impossible to remove this cosmetic residue later. Depending upon the prominence of the cosmetic residue, this potentially permanent "stain" may result in the clothing item being perceived as "ruined" and not fit for further use.

Figure 1:
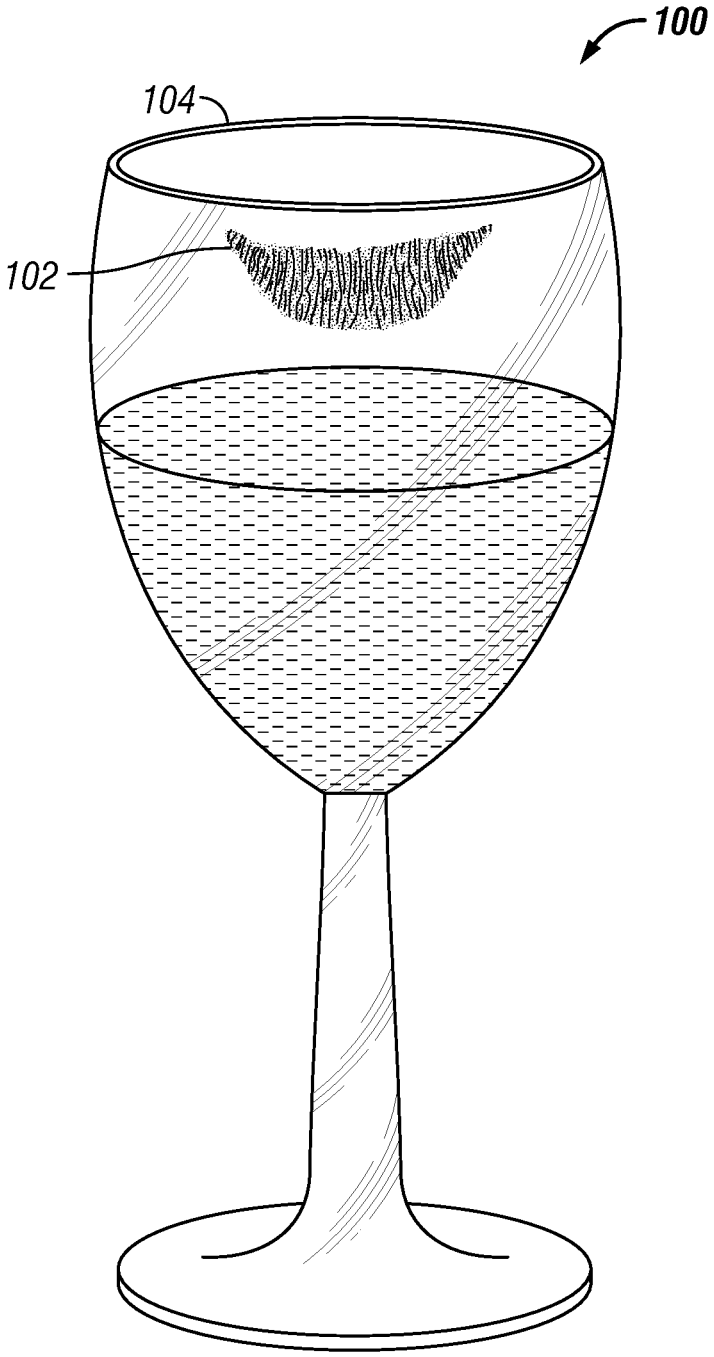
FIG. 1 depicts stem ware having a cosmetic residue on a rim surface.

The recently introduced long wearing lipsticks pose more significant residue issues than the older "traditional lipsticks. For example, referring to FIG. 1, even after putting drink ware, exemplified by wine glass 11, through a dish washing machine, stubborn residue 102 remains on the surface in the rim region 104 of the glass 100. The residue 102 may be more stubbornly attached in some cases and may be "baked on" after being subjected to the high temperature washing with detergent, and the hot air of drying of the washing machine. The same applies to long wearing lipstick marks on clothing that are "set" after heat drying during laundering. Whereas the traditional (not long wearing) lipstick formulations included waxes and oils, the long wearing lipsticks include wax-like synthetic polymers (also referred to herein as "polymeric waxes") and dimethicones. These polymeric waxes and dimethicones provide the long wear characteristic, but also contribute markedly to producing the stubborn cosmetic residue.

An exemplary embodiment provides a non-toxic, sanitizing formulation for removing cosmetic residue from surfaces, especially glass, porcelain, and polymeric surfaces and the surfaces of clothing made from natural or synthetic fibers, or a combination of both. It is theorized, without being bound, that the efficacy of the exemplary formulation may arise from its component compositions. These compositions include a polar solubilizer for the polymeric waxes and dimethicones present in the long wear lipsticks. The solubilized polymeric waxes interact with an anionic surfactant, and are thereby rendered soluble in the either the water of the formulation, if in aqueous form, or water added in the cleaning process. Because of detergent activity, the polymer waxes and dimethicones do not re-deposit. In addition, the formulations may include an anti-streaking agent that finish-cleans the surface to remove any streaks visible to the naked eye, and a conditioning agent that imparts a shiny, clean appearance.

In another exemplary embodiment, the polar solubilizer is a non-toxic, polar, liquid solvent, alcohol, such as ethanol, for example. Ethanol has significant advantages with regard to toxicity at low level concentrations in a cleaning formulation, as compared to acetone or other ketones, and aldehydes. Moreover it also has sanitizing properties. Anionic solubilizers that are non-toxic at levels of concentration left on cleaned surfaces, and with low or no risk of allergic reactions at these concentrations, are preferred.

In an exemplary embodiment, the surfactant is an anionic surfactant, or a mixture of such surfactants. Of these surfactants, a non-limiting, useful surfactant, or mixture of surfactants, may be selected from the group of the alpha-olefin-based sulfonates. An example of these is sodium sulfonate, and in particular, sodium 14, 16 alpha-olefin sulfonate. Anionic surfactants that are non-toxic at levels of concentration left on cleaned surfaces, and with low or no risk of allergic reactions at these concentrations, are preferred.

In an exemplary embodiment, the anti-streaking agent that cleans clear or translucent surfaces to a visibly streak-free appearance may be iso-propyl alcohol, for example, or a like anti-streaking agent. Anti-streaking agents that are non-toxic at levels of concentration left on cleaned surfaces, and with low or no risk of allergic reaction are preferred.

The anti-streaking agent is not essential, for example on porcelain that is opaque, but provides an added assurance of a streak free shine to clear or translucent surfaces, for example, acrylic or glass stem ware.

In an exemplary embodiment, a non-limiting example of the conditioning agent may be glycerin. Glycerin is non-toxic and provides a shiny, cleanly polished look to smooth surfaces, such as glass, acrylic or porcelain, for example. Conditioning agents that are non-toxic at levels of concentration left on cleaned surfaces, and with low or no risk of allergic reactions at these concentrations, are preferred. A non-limiting example of an alternative to glycerin may be hydroxylethyl urea, for example.

In an exemplary embodiment, a non-toxic, sanitizing formulation for removing cosmetic residue from glass and porcelain and polymeric surfaces includes an anionic surfactant; ethanol; and glycerin. Optionally, it may include an edible fragrance. The exemplary formulation may include from about 0.1 to about 10 wt. % iso-propyl alcohol, or about 5 wt. %. Further, the anionic surfactant may be present at from about 0.1 to about 3 wt. %., or about 1 wt. %. The formulation may have from about 35 to about 70 wt. %., or about 55 wt. % of ethanol. The formulation may have from about 0.1 to about 5 wt. %, or about 3 wt. % of glycerin. Optionally, the surfactant may be selected from the group consisting of sodium alpha-olefin sulfonates, and further optionally, the surfactant may be sodium 14, 16 alpha-olefin sulfonate, or a mixture containing it. The remainder of the composition is water, preferably deionized, to avoid ionic interference with the surfactant activity.

Another exemplary embodiment includes only the following active components, and may contain other components that are added to enhance smell, for example, but that do not provide any measurable activity in cleaning off residue: from about 0.1 to about 10 wt. % iso-propyl alcohol, or about 5 wt. %; from about 0.1 to about 3 wt. %, or about 1 wt. % anionic surfactant; from about 35 to about 70 wt. %., or about 55 wt. % of ethanol; and from about 0.1 to about 5 wt. %, or about 3 wt. % of glycerin. This embodiment is also non-toxic and has sanitizing properties.

A further exemplary embodiment provides a sanitizing wipe impregnated with a non-toxic aqueous formulation for removing cosmetic residue such as long wearing lipstick residue from glass, porcelain and plastic surfaces. The wipe acts as a carrier for a formulation having about 35 to about 70 wt. % ethanol; about 0.1 to about 5 wt. % glycerin; an anionic surfactant; isopropyl alcohol; optionally an edible fragrance; and water. The wipe may optionally be made of woven fibers, such as nylon, cotton, paper-pulp fiber, and the like, and mixtures of such fibers. Moreover, the wipe may be textured to provide a mild soft scrubbing to a surface and/or may be textured to enhance polishing of surfaces. An exemplary embodiment includes a wipe that has a rougher texture on one side for facilitating a slight scrubbing action, and a smoother surface of the other side to facilitate a polishing action. Optionally, the exemplary formulation in the wipe may include from about 0.1 to about 10 wt. % iso-propyl alcohol, or about 5 wt. %. Further optionally, the surfactant may be present at from about 0.1 to about 3 wt. %., or about 1 wt. %. Optionally, the formulation may have from about 35 to about 70 wt. %., or about 55 wt. % of ethanol. Optionally, the formulation may have from about 0.1 to about 5 wt. %, or about 3 wt. % of glycerin. Optionally, the surfactant may be selected from the group consisting of sodium alpha-olefin sulfonates, and further optionally, the surfactant may be sodium 14, 16 alpha-olefin sulfonate, or a mixture containing it.

Figure 2A:
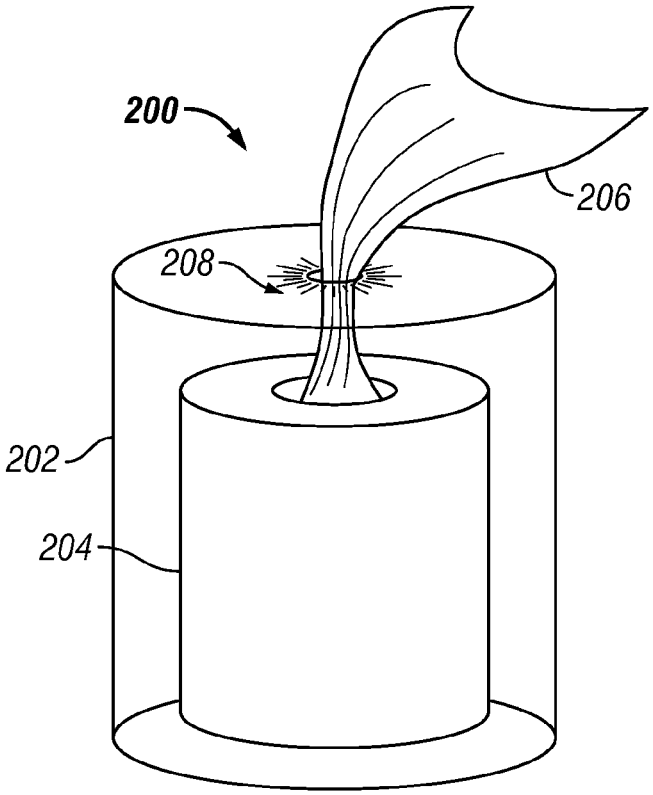
FIG. 2A depicts an exemplary embodiment of a dispenser containing wipes impregnated with a formulation according to an embodiment of the invention.
Figure 3:
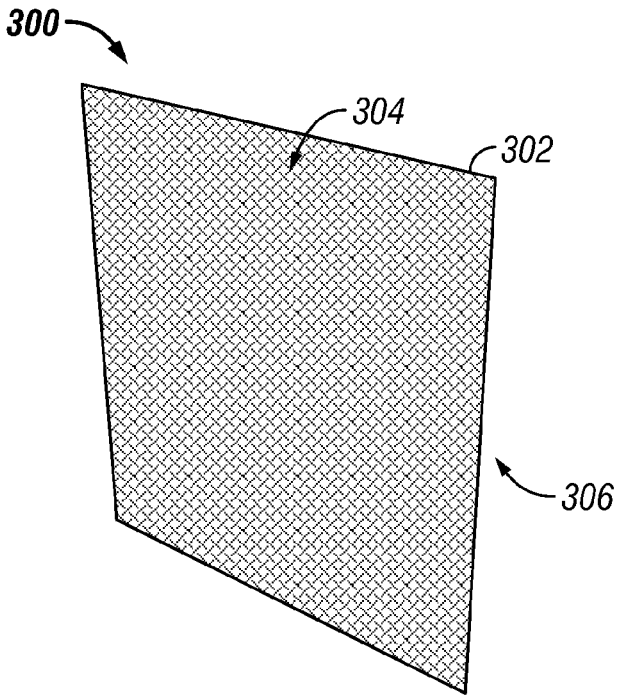
FIG. 3 depicts an exemplary embodiment of a single sheet wipe from a dispenser of FIG. 2.

FIG. 2A depicts an exemplary embodiment of a wipe dispenser 200, including a container 202 with a roll of wipes 204 therein. The wipes 206 may be pulled through the top 208 of container 202, which has means to detach one wipe 206 at a time as it exits from the container 202. An exemplary embodiment of a wipe 300, depicted in FIG. 3 has a first side 302 that includes texture 304 providing a roughened surface for scrubbing. The texture may be created by fibers, or by other suitable inclusions within the wipe material. The other side 302 of the wipe is not visible, but may be roughened or may be free of such surface roughening features, and may be suitable for polishing.

Figure 2B:
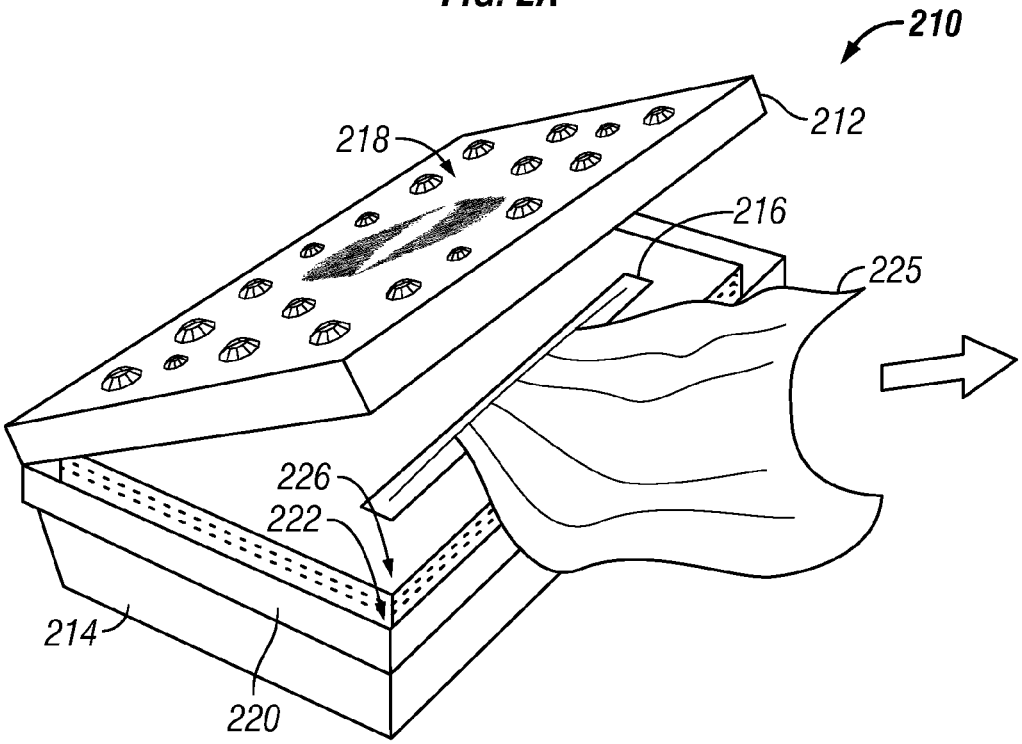
FIG. 2B depicts an alternative embodiment of a dispenser containing wipes impregnated with a formulation according to an embodiment of the invention.

FIG. 2B shows an alternative embodiment in which a plurality of wipes 226 are enclosed within a hinged case 210 that is sized to facilitate carrying in a women's purse or bag. In a non-limiting example, the case 210 may be about 2.5 inches wide, by about 4.5 inches long, and about 0.5 inches thick, and may have an attractive design (or coloration) on at least the upper surface 218 of lid 212. The lid 212 of case 210 is hinged to the base 214 that has an internal cavity for receiving multiple suitable folded wipes 226. The upper surface of the base 220 includes a slot 216 through which individual wipes 225 may be pulled from the case, one after the other. To facilitate refilling the case 210 when all wipes have been removed and used, the base 214 may have a hinged or otherwise removable upper lid 220 that allows access to the cavity inside base 214 for placing replacement wipes 226 therein. In an exemplary embodiment the case may be made from a suitable light-weight plastic material that is substantially non-reactive with the formulation on the wipes. In order to minimize evaporation of formulation from the wipes 226, the lid 212 may be designed to fit snugly over the upper edge of base 214 and seals to the base along the contact perimeter with the base 214. Other containment techniques to minimize evaporation may also be used.

Figure 2C:
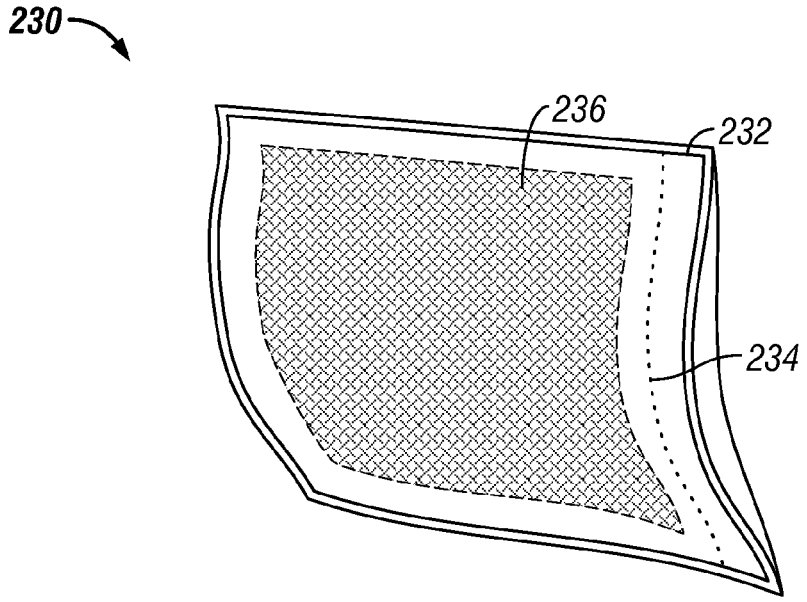
FIG. 2C depicts a further alternative embodiment of a dispenser containing a single wipe (or two or more wipes) impregnated with a formulation according to an embodiment of the invention

FIG. 2C depicts a handy, easy-to-carry sealed-pouch embodiment 230 of the technology. The pouch 232 contains a single wipe, or a pair of wipes 236 impregnated with an embodiment of a non-toxic, sanitizing formulation that is sealed within a pouch 232 of a material that minimizes or prevents evaporation of the formulation from the wipe(s). Such a material may be selected from non-reactive plastic films, metalized plastic films, or metal films. The pouch 232 optionally has a score-line that provides a line of weakness to facilitate tearing the pouch open to access the wipe(s) inside.

Figure 4:
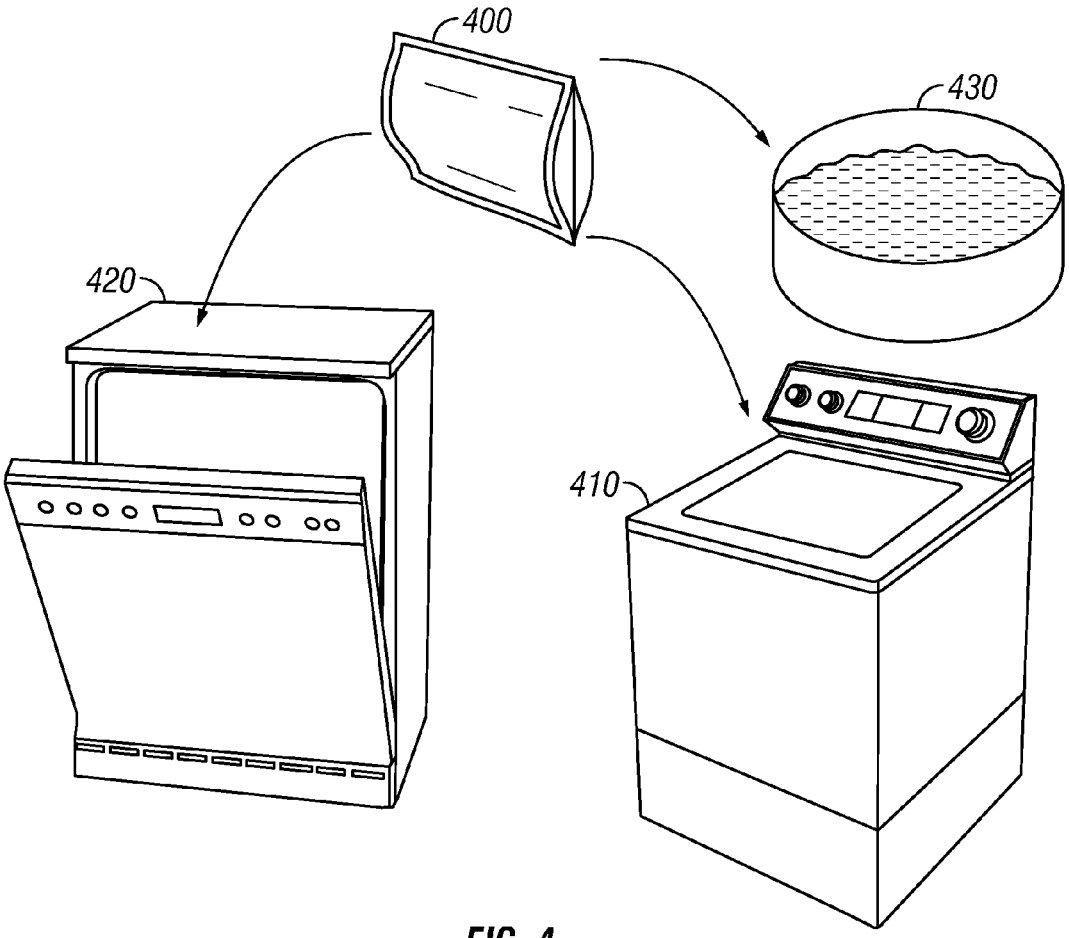
FIG. 4 depicts an exemplary embodiment of a sachet containing a formulation according to an embodiment of the invention, for dispersal in either a dish washing machine or a laundry washing machine.

Another exemplary embodiment provides a sachet filled with a non-toxic formulation for removing long wearing lipstick residue from glass, porcelain and plastic surfaces. In an exemplary embodiment, the sachet is sealed, but is water soluble, in exemplary embodiments. The sachet maintains the formulation within it until the shell of the sachet dissolves in the water that is used to clean the affected surfaces. As depicted in FIG. 4, the sachet 400 may be deposited into a clothes washing machine 410, or a dish washing machine 420, or to a tub 430 for manual washing of clothes or drink ware, or any other washable articles that have a cosmetic residue. The formulation has about 35 to about 70 wt. % ethanol; about 0.1 to about 5 wt. % glycerin; an anionic surfactant; isopropyl alcohol; optionally an edible fragrance; and optionally some water. Optionally, the exemplary formulation in the sachet may include from about 0.1 to about 10 wt. % iso-propyl alcohol, or about 5 wt. %. Further optionally, the surfactant may be present at from about 0.1 to about 3 wt. %., or about 1 wt. %. Optionally, the formulation may have from about 35 to about 70 wt. %., or about 55 wt. % of ethanol. Optionally, the formulation may have from about 0.1 to about 5 wt. %, or about 3 wt. % of glycerin. Optionally, the surfactant may be selected from the group consisting of sodium alpha-olefin sulfonates, and further optionally, the surfactant may be sodium 14, 16 alpha-olefin sulfonate, or a mixture containing it.

Another exemplary embodiment provides a bulk liquid non-toxic formulation for removing long wearing lipstick residue from glass, porcelain and plastic surfaces. The formulation is in concentrated form and can be diluted with water, preferably de-ionized water, in a 50:50 ratio. The bulk formulation prior to dilution includes from about 0.1 to about 10 wt. % iso-propyl alcohol, or about 5 wt. %. Further, an anionic surfactant is present at from about 0.1 to about 3 wt. %., or about 1 wt. %. The formulation also has from about 35 to about 70 wt. %., or about 55 wt. % of ethanol. The formulation may have from about 0.1 to about 5 wt. %, or about 3 wt. % of glycerin. Optionally, the surfactant may be selected from the group consisting of sodium alpha-olefin sulfonates, and further optionally, the surfactant may be sodium 14, 16 alpha-olefin sulfonate, or a mixture containing it.

Figure 5:
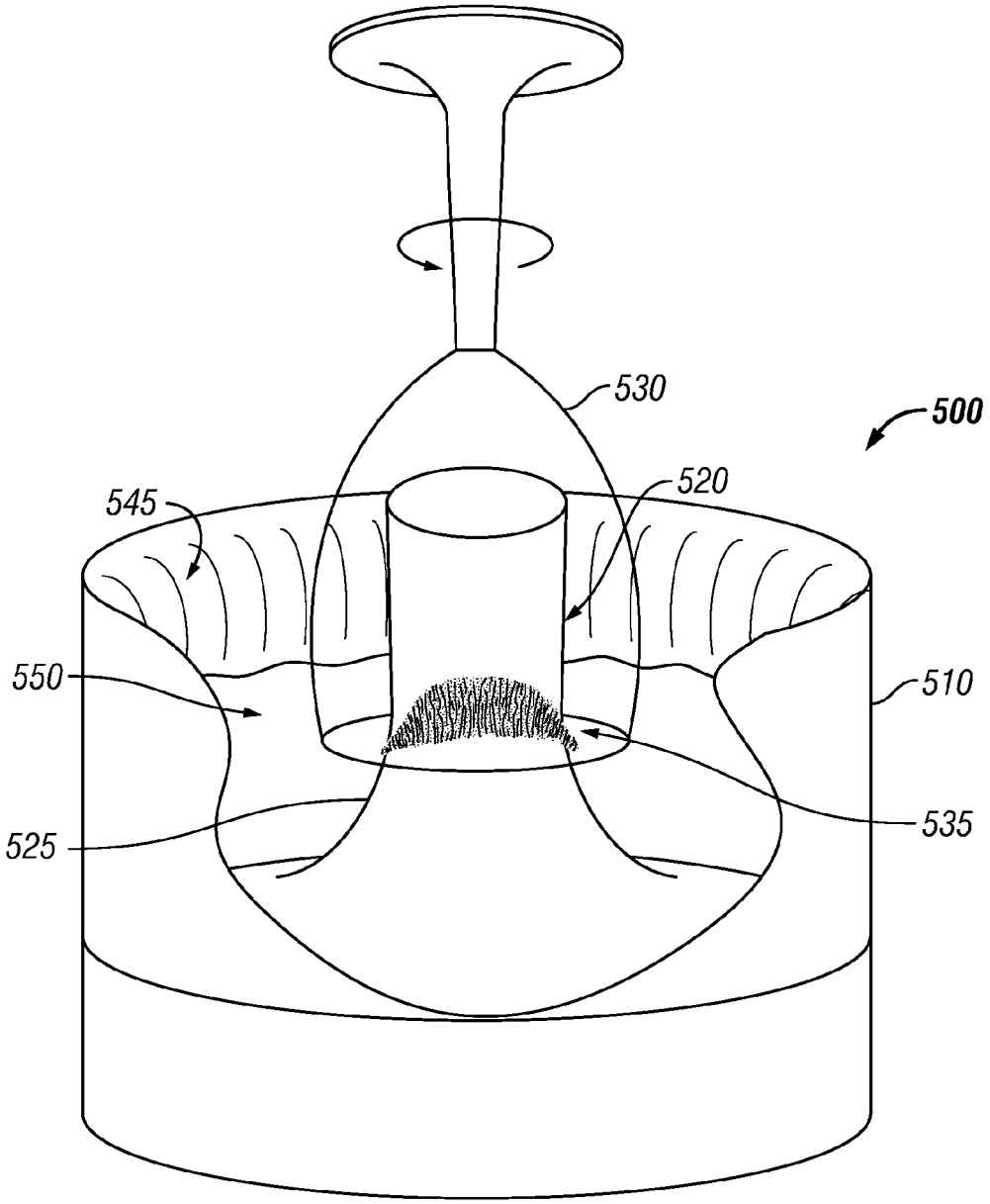
FIG. 5 depicts an exemplary embodiment of a device for cleaning the rime regions of stem ware by dunking in a formulation in accordance with exemplary embodiment of the invention.

Referring to FIG. 5, the bulk liquid may be dispensed in measured amounts into an exemplary embodiment of a drink ware washing apparatus 500. The apparatus 500 includes a substantially cylindrically shaped tub 510 that is at least partially filled with a formulation according to an exemplary embodiment. The tub 510 has a central vertical guide 520 adapted to receive the opening of a glass 530 or cup. By guiding the rotation of the glass 530 appropriately, its rim 535 that has cosmetic residue rubs against the inner side surface 545 of the tub 510 as well as against the outer surface 525 of the guide 520. These surfaces 545 and 525 may be slightly roughened but yielding to facilitate scrubbing of the cosmetic residue 535 from the glass 530 with the formulation 550 that at least partially fills tub 510. Or tub 510 may be lined with wipes, as described above, to facilitate the rapid cleaning of large numbers of glasses in a short time.

An exemplary embodiment of the formulation for removing cosmetic residues from surfaces includes chemical components that are non-toxic and have low risk of producing an allergic reaction when a human is exposed to the minor amounts left behind on a surface after that surface has been cleaned using the formulation, whether such exposure is by touch or through ingestion as from cleaned drink ware.

Figure 6:
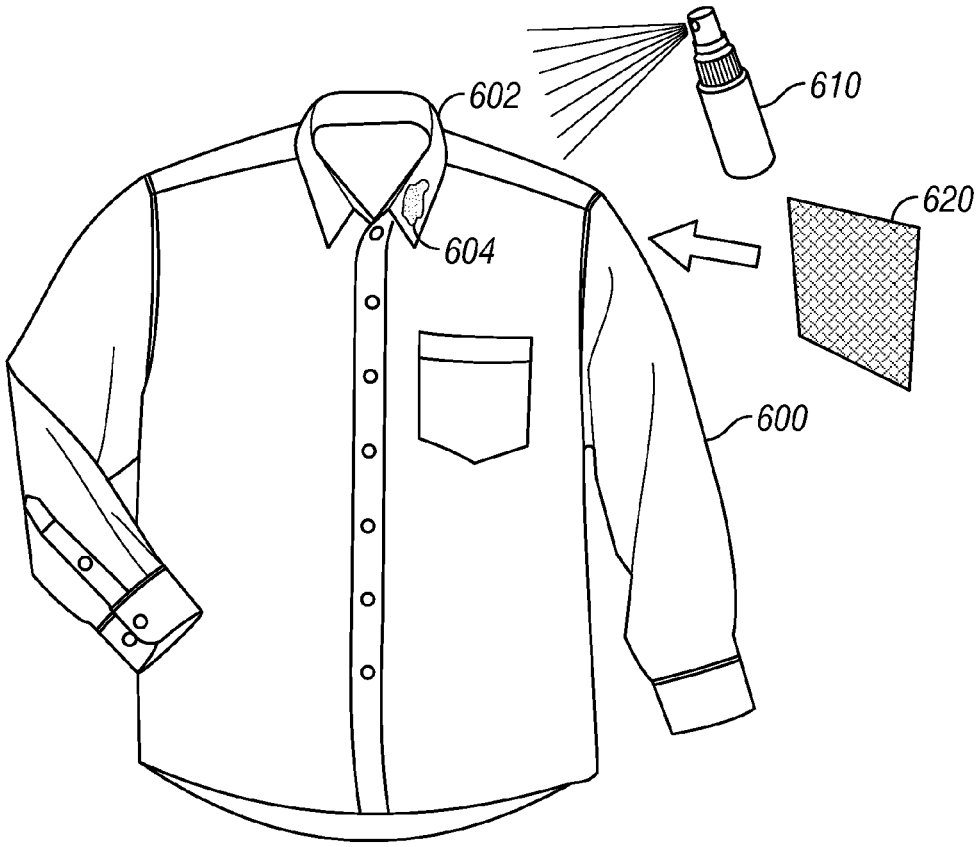
FIG. 6 depicts examples of the use of exemplary embodiments of the formulation to clean clothing marked with cosmetic residue.

FIG. 6, depicts cosmetic residue 604 on a textile fabric, in this example, a collar 602 of a shirt or blouse 600. An exemplary embodiment of the non-toxic formulation of the technology may be supplied in a spray bottle 610. This permits spraying a directed spray or stream of the formulation directly onto the contaminated area of the clothing to facilitate removal of the cosmetic residue 604. This removal may require additional actions, such as blotting with an absorbent cloth or sponge and repeated application of the spray-on formulation. Alternatively, a wipe 620, like that described above, with reference to FIG. 3, for example, impregnated with an embodiment of a formulation in accordance with the invention, may be used to selectively blot formulation onto the area affected by the cosmetic residue 604 and to thereby remove it. During blotting, care should be taken to avoid spreading the cosmetic residue to other parts of the garment or fabric.

While exemplary embodiments have been particularly shown and described, it will be understood by those skilled in the art that various changes in form and detail may be made therein without departing from the spirit and scope of the patent claims, and such equivalents thereof that a court may provide under the doctrine of equivalents.

The invention claimed is:

1. A method of removing cosmetic residue from surfaces including glass, porcelain, polymeric and textile surfaces, the method comprising the steps of:

applying to the cosmetic residue on the contaminated surface a formulation comprising concentrations of an anionic surfactant;

iso-propyl alcohol;

ethanol; and glycerin;

wherein the concentrations of the anionic surfactant, iso-propyl alcohol, ethanol and glycerin are sufficient to remove synthetic polymeric wax and dimethicone from the contaminated surfaces; and providing a non-toxic cleaned surface free of cosmetic residue, wherein, when the surface is glass, the cleaned surface has a streak-free, shiny, polished appearance.

2. The method of claim 1, comprising from about 0.1 to about 10 wt. % iso-propyl alcohol.

3. The method of claim 1, wherein the iso-propyl alcohol comprises about 5 wt. %.

4. The method of claim 1, wherein the surfactant comprises from about 0.1 to about 3 wt %.

5. The method of claim 1, wherein the surfactant comprises about 1 wt. %.

6. The method of claim 1, wherein the ethanol comprises from about 35 to about 70 wt. %.

7. The method of claim 1, wherein the ethanol comprises from about 55 wt. %.

8. The method of claim 1, wherein the glycerin comprises from about 0.1 to about 5 wt. %.

9. The method of claim 1, wherein the glycerin comprises about 3 wt. %.

10. The method of claim 1, wherein the surfactant is selected from the group consisting of sodium alpha-olefin sulfonates.

11. The method of claim 1, wherein the surfactant comprises sodium 14, 16 alpha-olefin sulfonate.

12. A method of removing long wearing lipstick residue from drink ware surfaces contaminated with the residue, before or after the drink ware has been subjected to cleaning in a dishwashing machine, the method comprising the steps of:

cleaning drink ware by applying to the drink ware surface contaminated with the residue a formulation comprising:

about 35 to about 70 wt. % ethanol;

about 0.1 to about 5 wt. % glycerin;

an anionic surfactant; and iso-propyl alcohol, wherein concentrations of the anionic surfactant, iso-propyl alcohol, ethanol and glycerin in the formulation are sufficient to remove the long wearing lipstick residue comprised of synthetic polymeric waxes and dimethicone from surfaces; and providing cleaned drink ware having a streak-free, shiny, polished surface appearance without leaving a toxic residue.

13. The method of claim 12, wherein the surfactant is selected from the group consisting of sodium alpha-olefin sulfonates.

14. The method of claim 12, wherein the surfactant comprises sodium 14, 16 alpha-olefin sulfonate.

15. The method of claim 12, comprising from about 0.1 to about 10 wt. % iso-propyl alcohol.

16. The method of claim 1, wherein the surfactant comprises from about 0.1 to about 3 wt. %.

17. A method of using a sanitizing wipe impregnated with a non-toxic aqueous formulation for removing long wearing lipstick residue comprising synthetic polymeric wax and dimethicone from drink ware surfaces, before or after the drink ware has been subjected to cleaning in a dishwashing machine, the method comprising the steps of:

wiping the drink ware with a wipe impregnated with a formulation comprising:

about 35 to about 70 wt. % ethanol;

about 0.1 to about 5 wt. % glycerin;

an anionic surfactant;

iso-propyl alcohol; and water, wherein the wipe is impregnated with anionic surfactant, iso-propyl alcohol, ethanol and glycerin in concentrations sufficient for the wiping step to remove the lipstick residue comprising synthetic polymeric wax and dimethicone from drink ware surfaces;

providing wiped drink ware with a non-toxic, streak-free, shiny, polished surface appearance free of micro-organisms associated with the cosmetic residue.

18. The method of claim 17, wherein the wipe comprises woven fibers.

19. The method of claim 12, wherein the surfactant is selected from the group consisting of sodium alpha-olefin sulfonates.

20. The method of claim 17, comprising from about 0.1 to about 10 wt. % iso-propyl alcohol.

21. The method of claim 12, wherein the step of applying comprises applying by dipping drink ware into a container of the formulation, the container having a guide receiving an opening of the drink ware, and further comprising rotating the drink ware against surfaces of the container and the guide to scrub off cosmetic residue.

22. The method of claim 1, wherein the step of applying comprises applying the formulation by spraying onto a textile fabric and blotting with an absorbent substrate to remove the cosmetic residue from surfaces.

23. The method of claim 1, wherein the step of applying comprises applying the formulation by depositing a sachet containing the formulation into a clothes washing machine or a dish washing machine.

24. The method of claim 17, further comprising, prior to wiping, removing the wipe from container having a plurality of wipes impregnated with the formulation therein.

* * * * *